United States Patent [19]

Bessinger et al.

[11] Patent Number: 4,884,847

[45] Date of Patent: Dec. 5, 1989

[54] APPARATUS AND METHOD FOR MAPPING ENTRY CONDITIONS IN REMOTE MINING SYSTEMS

[75] Inventors: Stephen L. Bessinger, Morgantown, W. Va.; Michael G. Nelson, Bethel Park, Pa.

[73] Assignee: Consolidation Coal Co., Pittsburgh, Pa.

[21] Appl. No.: 157,773

[22] Filed: Feb. 19, 1988

[51] Int. Cl.[4] ..... E21C 35/08

[52] U.S. Cl. ..... 299/1; 299/30; 175/40

[58] Field of Search ..... 299/1, 30; 175/40

[56] References Cited

U.S. PATENT DOCUMENTS

| | | | |
|---|---|---|---|
| 3,371,964 | 3/1968 | Weber | 299/1 |
| 3,974,330 | 8/1976 | Askowith et al. | 178/6.8 |
| 4,066,992 | 1/1978 | Buller et al. | 299/1 X |
| 4,167,290 | 9/1979 | Yamazaki et al. | 299/1 |
| 4,207,619 | 6/1980 | Klaveness | 367/81 X |
| 4,281,876 | 8/1981 | Lansberry | 299/1 |
| 4,323,280 | 4/1982 | Lansberry et al. | 299/1 |
| 4,463,378 | 7/1984 | Rambow | 358/112 |
| 4,688,937 | 8/1987 | König et al. | 299/1 X |
| 4,708,395 | 11/1987 | Petry et al. | 299/1 X |

*Primary Examiner*—William P. Neuder

*Attorney, Agent, or Firm*—Alan N. McCartney

[57] ABSTRACT

The method and apparatus for mapping mine excavation or tunnel entry conditions by mounting an array of sensors on a vehicle some of which provide knowledge of the vehicle location in the entry and others of which provide knowledge of entry conditions and by interpreting data collected from the sensors, a map can be generated of the entry strata for a given vehicle location in the entry. This map can be compared with similarly generated maps to indicate changes in the entry condition.

8 Claims, 3 Drawing Sheets

APPARATUS AND METHOD FOR MAPPING ENTRY CONDITIONS IN REMOTE MINING SYSTEMS

BACKGROUND OF THE INVENTION

1.Field of the Invention

It is the purpose of this invention to provide an array of sensors on a remotely controlled mining system to map the entry condition and computer store the generated knowledge for comparison to other similar surveys to indicate changes in the entry condition to the operator or the mining system control.

2. Summary of the Prior Art

There are teachings in the prior art of utilizing television cameras to monitor mine entries or bore holes to present an image to the operator of strata condition. For example, in U.S. Pat. No. 4,281,876, electromagnetic signals are generated indicative of the illuminated surface of the mine, the signals being transmitted to a remote control station having a visual display for monitoring movement. In U.S. Pat. No. 4,323,280, television cameras are mounted on the miner so that the machine can be remotely controlled. In U.S. Pat. Nos. 3,974,330, 4,167,290 and 4,463,378, there are illustrated devices for inspecting boreholes. U.S. Pat. No. 3,371,964 discloses using a scanner on a longwall miner to monitor mine roof conditions.

SUMMARY OF THE INVENTION

It is an object of this invention to provide an array of sensors on a remote mining system which can map the mine entry condition for both routine machine guidance and for indicating severe strata disturbances requiring changes in or termination of a programmed mining cycle.

It is also an object of this invention to provide instrumentation for generating maps while mining, excavating, or tunnelling in automated, manless systems as well as mapping existing entries, where human entry for some reason is not feasible. It is a further object of this invention to provide an array of sensors on a remotely controlled vehicle, some of which respond to vehicle functions to provide knowledge of vehicle location in a mine entry, excavation, or tunnel, and others of which provide knowledge of entry conditions. Subsequent interpretation of such knowledge generates a map of entry conditions for a given location of the vehicle in the entry.

DESCRIPTION OF THE PREFERRED EMBODIMENT

This invention represents the application of traditional well-logging techniques to remote, automated mapping of underground mine entries, excavations, or tunnels. In well-logging, various properties of the earth surrounding a drill-stem are measured while a hole is being drilled. These measurements are made by an instrumentation package, often called a sonde, which is located behind the drill cutters. As the drill advances into the earth, the readings from the sonde are recorded, along with the position, or depth, of the sonde at which each reading is made. This allows for construction of a well log, which shows a plot of each instrument reading vs. hole depth. The log thus provides a 'picture' of the geological strata surrounding the hole. The underlying principle in well-logging is the correlation of instrument readings with the location at which those readings were taken.

With recent developments in instrumentation, data telemetry, and guided-vehicle technology, the well-logging concept can be extended to the remote mapping of mine entries, excavations, or tunnels. The basic invention disclosed herein has two embodiments: one for generation of maps while mining, in automated, manless mining systems; the other for mapping existing entries, where human entry is for some reason not feasible.

In a manless mining system, continual mapping of entry conditions will be necessary for both routine machine guidance and for indication of severe disturbances requiring changes in or termination of the programmed mining cycle. Such a system will require periodically updated maps of conditions over the entire length of the entry, not just at the point where material is being excavated.

A remotely-guided mapping vehicle would be useful for surveying abandoned mines, excavations, or tunnels, or areas in operating mines where human access is impossible or unsafe. Such a vehicle may also eventually be more economical than a human survey team.

When using manless, remotely-controlled, or automated mining systems, it will be necessary to monitor the entry conditions, so that both the operators and the control system can be notified when indicating obstacle hazards are present or ground control conditions are deteriorating.

Figure 1:
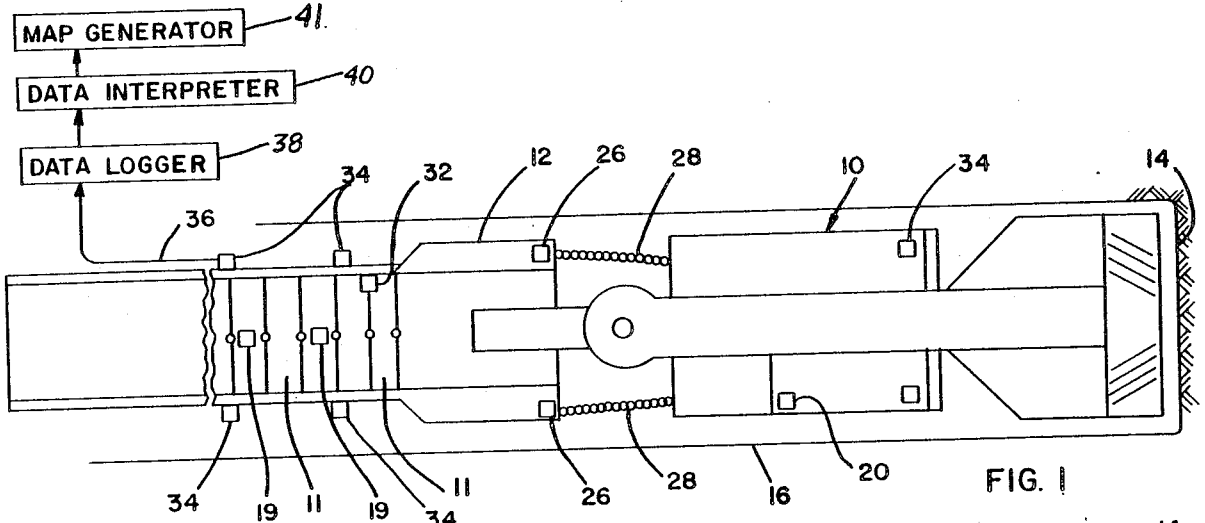
FIG. 1 is a diagramatic top plan view of a continuous miner and tramming conveyor having mounted thereon the instrumentation for performing the invention herein.
Figure 2:
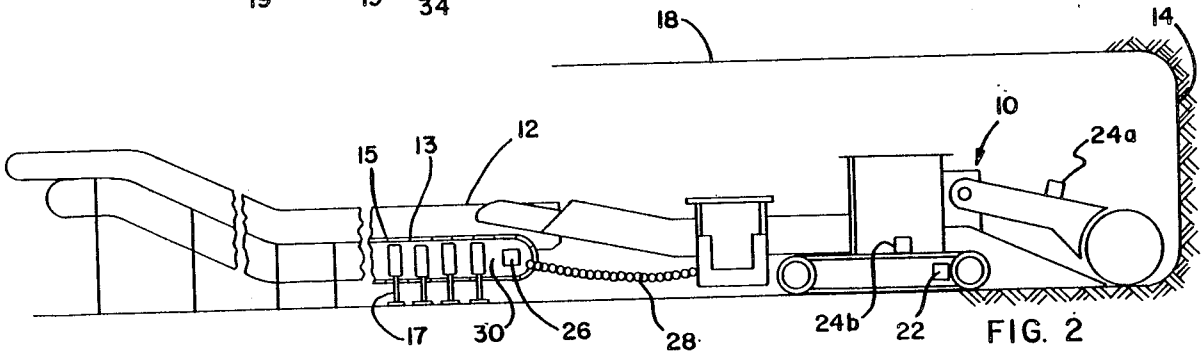
FIG. 2 is a diagramatic side elevational view of a continuous miner.

In the proposed application, a sensor, or an array of sensors, will be mounted on a piece of mobile mining equipment such as a continuous miner 10 or tramming conveyor 12. (See FIGS. 1 and 2). As the equipment is backed out of or run into a heading 14 at a uniform speed, the sensors can be used to generate a profile map of both ribsides 16 or the roof 18 for the full length of the entry. This information can be stored for comparison with either next or the previous survey. The result of comparing surveys will indicate both the amount and rate of the entry's degradation. This information can then help determine whether or not mining will continue in that location.

This invention is intended to cover any such system that takes advantage of the linear translation of an ultrasonic, radioactivity-based, electromagnetic, or photosensitive sensor along the full or partial length of an underground excavation to generate excavation profiles for the purpose of guidance and control of remotely-controlled, automated, or robotic mining systems and equipment.

To perform the mapping function, information about the heading, height, width, and condition of the entry being mined are gathered and transmitted to the surface, for computer analysis, and subsequent generation of entry maps and profiles. It is important to note that much of the information used for mapping is generated by instruments used to control the mining system and indicate the location of the mining system in the entry. Of equal importance is the fact that accurate entry maps and profiles will probably not be developed by simple deduction from the instrument data; rather, a more complex, knowledge-based algorithm will be required. In the following description, the instrument configuration employed is that which is currently conceived for a highwall mining system.

The mining system described comprises a continuous mining machine 10 and a tramming, or self-advancing, conveyor 12. The conveyor 12 typically comprises a plurality of pivotally interconnected body members 11 around which a continuous conveyor chain 13 having flights 15 is carried. The conveyor 12 transports when in the position of being raised by hydraulic cylinders 17 and trams on chain 13 when in the lowered position. The miner 10 is steered by referencing a digital, flux-gate magnetometer, or digital compass 20, and monitoring the rotation of the gears which drive the miner's cat treads by the use of cog counters 22 on the cat tread drive gears using proximity sensors. The height of the miner's cutter boom is indicated by inclinometers 24(*a*) mounted on the boom. The inclinometers 24(*a*) are used in the automatic control of the coal cutting cycle. The inclinometer 24(*b*) on the body of the machine will indicate the slope of the entry along the direction of mining. The conveyor is steered and kept in alignment with the miner by monitoring through strain gages 26, the strains at the mounting points of two chains 28, which couple the conveyor to the miner, and adjusting the steering head 30 of the conveyor 12 to maintain the strains at the two points at near equal levels. Conveyor advance is monitored by counting (by means of proximity sensors 32, for example) the passage of "markers" in the drive system, e.g., chain conveyor flights or cat tread drive gear teeth. Roof and rib conditions are monitored by energy emitter/detector devices 34 mounted on the two machines. These may be sonic, ultrasonic, optical, or radio frequency devices, depending on mine conditions and the accuracies desired. Also included in the instrumentation is conveyor pan angle sensors 19. The information collected in this manner can be transported to the surface by a fiber optic cable 36, for example, and received by a data logger 38 which would pass the information to a data interpreter 40 which is connected to a map generator 41.

As the miner advances, data from its steering system are used to calculate the position and heading of the miner. Inclinometer readings from the miner's cutter boom are used to control the roof and floor cutting horizons, in relation to the position of the miner. Roof and rib monitors respectively measure roof height above the machine and entry width on either side of the machine. All of this information is used to generate entry maps and profiles.

As the conveyor advances behind the miner, its position is calculated, based on the marker counting system. Roof and rib monitors mounted at intervals along the conveyor give respective indication of roof falls or rib spalling, when their readings are compared with those taken earlier at the same location. This allows for cross-checking of the profiles calculated from data generated by the miner's instruments, and also provides for a periodic updating of the entire entry profile.

The important thing to note in this system is not the use of certain instruments to measure entry conditions, but the use of any appropriate combination of instruments and data logging devices to simultaneously measure and record both the instrument readings and the position and orientation of the mining equipment, on which the instruments are mounted.

At each point in the mining cycle at which the equipment is stationary, the entry mapping system's data logger 38 polls the condition sensing instruments, and also records the readings of the instruments which measure position and orientation of the equipment. Then, knowing the exact location of each instrument along with its reading, an expert or knowledge-based algorithm 40 interprets the data to construct a "snapshot" image of the entry at that position. As the system advances, repeated snapshot images are recorded, and combined to constitute a map of the entry.

With the condition sensing devices mounted at intervals along the conveyor, their readings can be compared at identical locations as the system advances, to give an indication of roof falls, floor heave, and rib deterioration.

This concept could also be applied to an independent, remotely-guided vehicle, used to survey dangerous areas, abandoned workings, etc. The vehicle would be similarly instrumented, so that its position and orientation within an entry would be continuously recorded. It would be fitted with a similar, appropriate complement of entry condition sensors as disclosed hereinafter.

Figure 3:
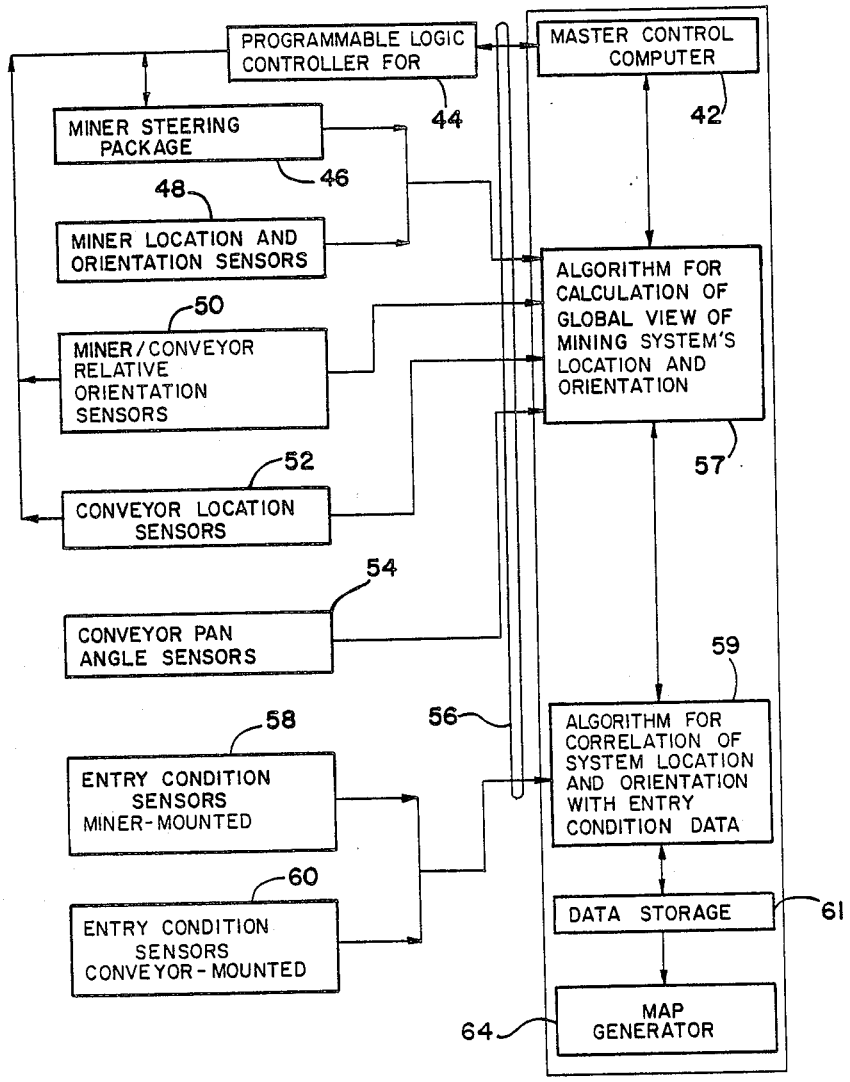
FIG. 3 is a schematic view of a control system for accomplishing one form of the invention herein.

Reference is now made to FIG. 3 which discloses a schematic diagram of the instrumentation for entry mapping in a remote mining system.

The master control computer 42, is the supervisory unit for the system. When this computer initiates a cycle, the programmable logic controller 44, begins its control of sub-cycle of mining. The miner executes its cutting sequence, then advances. As it advances, its location and orientation relative to an absolute reference point are measured and controlled by the steering package 46, and the miner location sensors 48, consisting of instruments described hereinafter. The position and orientation of the miner, relative to the conveyor's head section, are measured by the relative orientation sensors 50. When these sensors indicate that the miner has advanced as far as is possible for the current conveyor position, the conveyor is advanced. As the conveyor advances, its progress is measured by the conveyor location sensors 52. When these sensors indicate that the conveyor has reached the correct position, conveyor advance is stopped, and conveying begins again. The pan angle sensors 54, sense angular displacement of adjacent conveyor sections. This describes one complete mining cycle.

Throughout the entire cycle, data from the location and orientation sensors 46 to 54, are transmitted to the master control computer over the data link 56. Periodically, the control computer analyzes these data and generates a global view (at 57) of both the location and orientation of the entire mining system, relative to an absolute reference point. The primary purpose of this analysis is to provide information for control of the mining system. However, it may also be used, in combination with other data, to provide a continually updated, three-dimensional image (map) of the entire mine entry.

The additional data needed for entry mapping comes from entry condition sensors 58 and 60, mounted on both the miner and the conveyor. Data from these sensors are also transmitted to the control computer throughout the mining cycle by way of data link 56. Periodically, the control computer analyzes these data at 59. Because the computer can store the data from all instruments 46 to 54, along with the time at which every data point was received, it can store (at 61) and correlate all the relevant data for any given time to generate a map of the entry at that time (depicted at 62). It is important to note that the data must be correlated in this manner. While the data from a particular entry condition sensor may be useful on their own for indicating roof sag, floor heave, rib sloughage, etc., these data cannot be used for mapping unless at the same time the position of the sensor, relative to an absolute reference point, is known.

The correlated data are stored in the computer's memory 61 and from these stored data, maps may be generated automatically, at pre-selected times, or as required (64).

Figure 4:
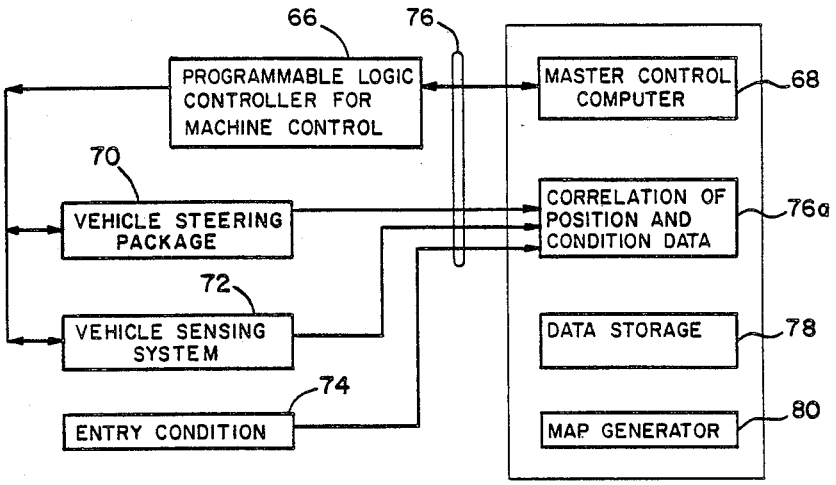
FIG. 4 is a schematic view of another control system for accomplishing another form of this invention herein.
Figure 4A:
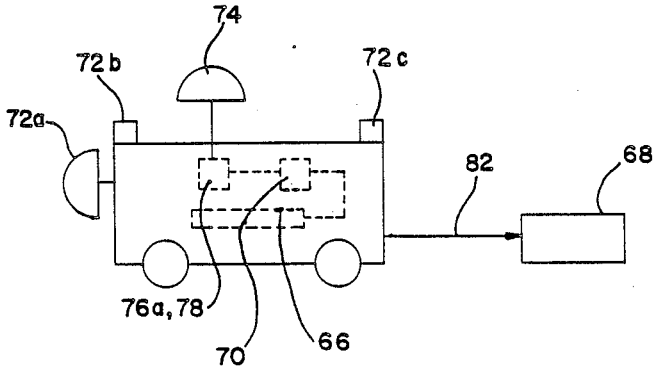
FIG. 4*a* is a diagramatic illustration of the vehicle using the system of FIG. 4.

Options for the various components in the schematic diagram of FIG. 3 include:

- Miner Steering Package
- instruments
  - flux-gate magnetometer (compass)
  - ring-laser or conventional gyroscope
  - radar guidance
  - laser guidance
  - closed-circuit TV
  - inclinometers
- control
  - human remote
  - on board, fully automatic
- Miner Location Sensors
  - drive gear cog counting, using proximity sensors
  - laser, radar, sonic, or ultrasonic ranging
- Miner/Conveyor Relative Orientation
  - tethering chains with strain gaged mountings
  - laser, radar, sonic, or ultrasonic ranging
  - inclinometers
- Conveyor Location Sensors
  - flight counting, using proximity sensors
  - laser, radar, sonic, or ultrasonic ranging
- Conveyor Pan Angle Sensors
  - rotary shaft encoders, optical or mechanical
  - rotary potentiometers
- Entry Conditions Sensors
- Entry profiling (distance from sensor)
  - laser, radar, sonic, or ultrasonic ranging
  - mechanical 'feelers', coupled to potentiometers
  - fiber-optic feelers, coupled to interferometers
- Material sensing (e.g., coal thickness, location in potash seam)
  - natural gamma attenuation
  - RF electromagnetic back impedance
  - x-ray fluorescence
  - UV fluorescence
  - etc.
- Moisture detection
  - commercial devices readily available
- Roof falls, cracking, etc.
  - sonic, ultrasonic, or microseismic detectors The remotely guided mapping vehicle has much in common with the mapping scheme for remote mining systems. Referring to FIGS. 4 and 4(*a*), the vehicle is controlled by a programmable logic controller 66, which in turn is subject to a master computer 68. The vehicle has a steering package 70, and a sensing system 72(*a*) to (*c*). The sensor heads 72(*a*) and (*b*) can be fixed or rotating array of sensors such as energy reflection ranging instruments and passive or active radiation devices for material sensing. The sensor 72(*c*) can be dual inclinometers to measure pitch on two axes. The steering package 70 may either be totally automated (on board computer) or remotely controlled by a human operator. The vehicle may be wheel or track driven. As the vehicle advances, the entry condition sensors 74 (such as a roof sensor), record survey data. Again, all data are transmitted to the control computer over the data link 76, for correlation and map generation. This data may simply be stored on the vehicle and down loaded to a map-generating computer later so that no data link is required. The collected data can be received from the interpreter 76(*a*) and stored at 78 for subsequent map generation (80). Additionally, a data link 82 may comprise a hard wire, radio frequency, or fiber optic cable linked to the master controller 68 on the surface or at a safe underground location.

Options for the various components in FIG. 4 include:

- Vehicle Steering Package
- Instruments:
  - flux-gate magnetometer (compass)
  - ring-laser gyroscope
  - conventional gyroscope
  - radar guidance
  - laser guidance
  - closed-circuit TV
- Control
  - human remote
  - on board, fully automatic
- Vehicle Location Sensing System
  - gear tooth counting
  - conventional odometry
  - laser, radar, sonic, or ultrasonic ranging It can thus be seen that through the use of an array of sensors, vehicle position and entry condition can be correlated to generate a map of entry condition.

We claim:

1. Method of mapping strata and profile conditions in a mine, tunnel, or excavation entry through the use of a self propelled vehicle transportable in the entry comprising a. placing an array of sensors on the vehicle to develop knowledge of entry conditions;

b. placing instrumentation on the vehicle to develop knowledge of location of the vehicle in the entry;

c. collecting said knowledge of entry conditions and vehicle location;

d. generating a survey map of the entry conditions indicative of a given location of the vehicle;

e. storing said knowledge; and, f. comparing said generated survey map with another similarly generated survey map to develop a history of change in entry conditions.

2. The method of claim 1 including remotely controlling the vehicle.

3. The method of claim 1 wherein said instrumentation is an array of sensors on the vehicle each sensing the functioning of a vehicle moving part to provide knowledge of vehicle location in the entry.

4. The method of claim 3 wherein the vehicle is a continuous miner and a tramming conveyor, with sensors located on the miner indicating miner location and orientation and sensors on the conveyor indicating conveyor orientation relative to the miner and conveyor location.

5. The method of claim 1 wherein said vehicle is a continuous miner and a tramming conveyor with said sensors being located on the miner and conveyor.

6. A remotely controlled self propelled vehicle transportable through a mine, excavation, or tunnel entry and having first sensor means mounted thereon for reading the functioning of various apparatus associated with the vehicle to develop knowledge of the location of the vehicle in the entry, and second sensor means mounted on the vehicle reading profile and strata conditions in the entry, and means accepting the output of said first and second sensor means to generate a map of the profile and strata condition of the entry for a given location of the vehicle so that the generated map can be compared to a similarly generated map to indicate change in profile and strata condition of the entry.

7. The vehicle of claim 6 wherein the vehicle includes a continuous miner and a trimming convey or.

8. The vehicle of claim 7 wherein said first sensors are mounted on said miner and said tramming conveyor and provide information relative to the functioning of said miner and said tramming conveyor and said second sensors are mounted on said miner and said tramming conveyor.

* * * * *